US007578158B2

(12) United States Patent
Frattini

(10) Patent No.: US 7,578,158 B2
(45) Date of Patent: Aug. 25, 2009

(54) PROCESS FOR THE SHAPING OF THE SURFACE OF A METAL CONTAINER

(75) Inventor: Roberto Frattini, Ponteranica (IT)

(73) Assignee: Frattini S.p.A. Costruzioni Meccaniche, Seriate (IT)

( * ) Notice: Subject to any disclaimer, the term of this patent is extended or adjusted under 35 U.S.C. 154(b) by 160 days.

(21) Appl. No.: 11/666,850

(22) PCT Filed: Jun. 21, 2005

(86) PCT No.: PCT/EP2005/006672

§ 371 (c)(1),
(2), (4) Date: May 2, 2007

(87) PCT Pub. No.: WO2006/048056

PCT Pub. Date: May 11, 2006

(65) Prior Publication Data

US 2008/0006072 A1 Jan. 10, 2008

(30) Foreign Application Priority Data

Nov. 8, 2004 (IT) ..... MI04A2138

(51) Int. Cl.
*B21D 11/10* (2006.01)

(52) U.S. Cl. ..... 72/379.4; 72/94; 413/69

(58) Field of Classification Search ..... 72/94, 72/105, 348, 379.4, 405.03, 414, 420, 421, 72/422; 413/69
See application file for complete search history.

(56) References Cited

U.S. PATENT DOCUMENTS 3,628,451 A 12/1971 McClellan et al.
4,120,190 A * 10/1978 Schlau et al. ..... 72/458
4,341,103 A * 7/1982 Escallon et al. ..... 72/70
4,487,048 A * 12/1984 Frei ..... 72/94
6,009,753 A * 1/2000 Tsang et al. ..... 73/514.32
6,338,263 B1 * 1/2002 Obata et al. ..... 72/105
7,024,912 B2 * 4/2006 Campo et al. ..... 72/414

FOREIGN PATENT DOCUMENTS

EP 1214991 12/1971
EP 0275369 7/1988
WO WO 0158618 8/2001

OTHER PUBLICATIONS

International Search Report Aug. 9, 2005.

* cited by examiner

*Primary Examiner*—Edward Tolan
(74) *Attorney, Agent, or Firm*—Bucknam and Archer

(57) ABSTRACT

A process for the shaping of the side surface of a metal body or container (10) such as an aerosol or a beverage bottle for food or technical use, obtained by progressive deformation operating steps of its side surface carried out in sequence on a machine having an intermittent rotating table, an opposite alternate translatory motion plate, a loading drum, gripping pliers of the bodies, deformation and possibly embossing and/or debossing tools and an unloading drum of the same bodies, the process including the steps: feeding the bodies (10) on the machine provided with an intermittent rotating table and of an opposite translatory motion plate; gripping the bodies along a limited area (12) between 10.0 and 35.0 mm, of their side surface from the bottom with a fixed or an axially rotating gripping plier; carrying out a broad deformation (18) on the side surface of the bodies (10) with tools working from the inner and/or outer part of the same bodies.

11 Claims, 1 Drawing Sheet

PROCESS FOR THE SHAPING OF THE SURFACE OF A METAL CONTAINER

Figure 1:
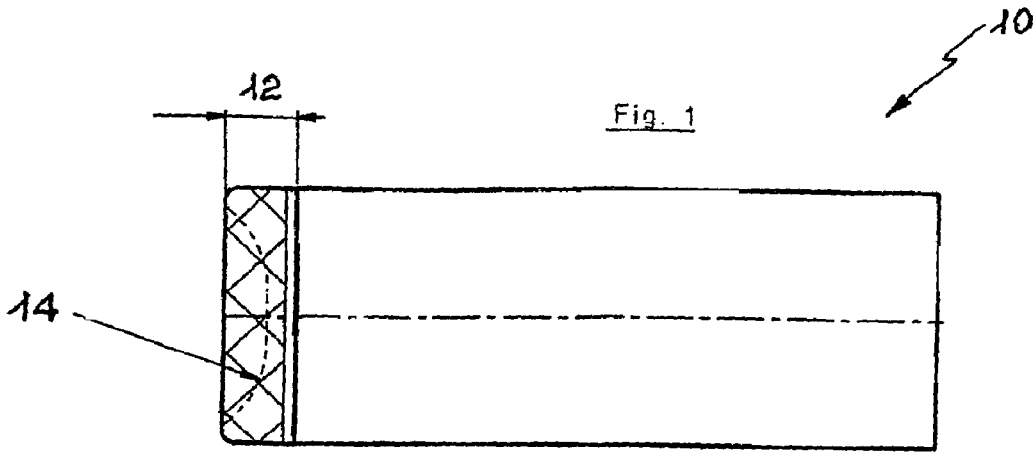

Applicant claims priority under 35 U.S.C. §119 of Italian Application No. MI2004A002138 filed Nov. 8, 2004. Applicant also claims priority under 35 U.S.C. §365 of PCT/EP2005/006672 filed Jun. 21, 2005. The international application under PCT article 21(2) was published in English and amended on Oct. 28, 2005 pursuant to PCT Rule 44.1.

DESCRIPTION

The present invention refers to a process for the shaping of the surface of a metal container. More particularly the present invention refers to a process to carry out the forming of any shape, size and development on the side surface of a metal container.

The metal containers submitted to the process of the present invention are particularly, but not exclusively, the ones made of aluminium, its alloys, steel or other suitable materials by which aerosol or beverage bottles for food or technical use having a substantially cylindrical shape are obtained.

Those substantially cylindrical shape aerosol or beverage bottles are subsequently tapered in the known way at its upper end, for example, but not only for this purpose, for the subsequent application of a dispenser valve or of a thread for a closing cap. Said containers are presently obtained by extruded preformed or drawn bodies. Before the shaping operations, which are the subject matter of the present process, these bodies can be painted in their inside and outside parts and lithographed on their side surface to obtain notices or decoration elements in different colours, such as the trademark of the products, the content type, the relevant ingredients and instructions for consumers, particularly for consumer products. After the process of the present invention, the same extruded, drawn or otherwise obtained bodies which can be lithographed or painted, are fed on a known tapering machine of the type comprising at least an intermittent moving rotating table with multiple stations equipped with pliers or the like to temporarily fasten the bodies and at least an opposite alternate intermittent rotating table upon which various tools and spindles are placed and designed to intervene, according to the intermittent rotating table, with continuous and preset sequences on the extruded or drawn bodies in order to carry out the subsequent tapering steps of the upper end and other operations such as the size cutting, the flanging and size control of said upper end which has been treated and deformed in this way.

The feeding of said bodies on the known tapering machines is obtained by a known rotating drum and the same is for the unloading of the worked bodies for which a similar drum is arranged.

According to a known and recent production method, the extruded or drawn metal bodies, which are mainly designed for the aerosol, beverage, food and technical use, are submitted, on known tapering machines, to one or more operations which are not limited to the tapering of their upper edge but they also carry out localized deformations of their side surface. These deformations, defined with the "embossing" or "debossing" terms, are carried out with appropriate forming tools and create on said bodies embossed or debossed sectors which generally extend along limited portions of the side surface in order to obtain a mitering configuration, shaped impressions and the like. These solutions, whose function is partly ornamental and partly functional and which allow a safer gripping of the body by the user, are described in the patent applications no. EP 01129572.2 and no. EP 01129573.0, and in the international patent application WO 01/58 618. These patent applications disclose all the features of the preamble of claim 1.

The above-mentioned prior art provides the method to carry out embossed and/or hollowed impressions with a limited and detailed development on said containers which do not significantly alter the substantially cylindrical development of part of the bodies upon which they are created. Said localized impressions or deformations are present on a limited area of the side surface of the bodies which is generally relevant to their part situated near or immediately under the tapered area.

Presently, on the contrary, the need of carrying out metal containers made of aluminium, its alloys, steel or other metal materials mainly for the beverage, aerosol, food, technical or other use with extended shapings subsequent to plastic deformations of their whole side surface or of a broad part of it, in order to give these containers configurations or aesthetical and functional features similar to the ones existing on containers made of other materials such as plastic which is not attractive as for marketing and the glass which is very heavy and is subject to easy breaking is required. Said shapings, deriving from deformations which are broadly distributed on the side surface of the bodies and can alternate with areas comprising debossing or embossings, i.e. impressions formed with embossing or debossing, according to the present invention are present at least in the part of said surface comprised between the sector to be subsequently tapered and the base of the bodies from which they are spaced of a limited portion, which is comprised, by way of example, between 10.0 and 35.0 mm. The known embossing/debossing and tapering operations comprise many operating steps on the table rotating machines during which various tools and relevant pliers, to grip and temporarily hold the bodies, intervene. During the operating operations these tools and pliers must be perfectly stabilized from the bottom area opposite to the mouthpiece. During the tapering operations, the block of the bodies does not give particular problems, as the same bodies can be gripped from the bottom with suitable and known gripping pliers, the gripping area can extend along the side surface for a relevant portion as can be noticed from the above-mentioned patent applications. The bodies which are blocked by the various pliers surrounding a broad area of the side surface from the bottom are properly stabilized and the gripping effect of the same pliers does not impede the deformation or tapering process. In case of deformations of bodies affecting a wide area of their side surface and extending up to their base or near it, important drawbacks occur which do not allow to stabilize and keep the same bodies perfectly blocked according to the method which is used while carrying out the deformation/tapering in the known way. On said bodies, the deformation request of the side surface is noticeably extended in height to reach the area close to the bottom. It ensues that the gripping pliers can surround the bodies only for a limited part of the side surface from the bottom, so that the blocking of the bodies along this limited area of the side surface involves some relevant drawbacks.

In fact, even if the bodies are held only on a limited area from the bottom, they need to be efficiently stabilized, as the loads to which they are submitted are much higher than the ones of the known processes.

This is due to the fact that a broad part of their side surface is submitted to working, with great efforts of the deformation tools operating from the outside part, the inner part or in both directions. Moreover, the same performance, which can be obtained on the bodies blocked along a broad area of the side surface for the even alignment of the bodies, must be kept.

In the presence of a limited lever arm compared to what occurs to the known processes, even the least error in the gripping of the bodies, noticeably amplifies to their opposite free end and the ensuing misalignment compromises the accurate and proper integration between the tools and the bodies for the deformation of the side surface of the same bodies. The gripping strength of the blocking means of the bodies, which is for example made of a plier with annular gripping areas, requires a suitable contrast through the deformation of their bottom in order to avoid the risk of buckling of the same bodies near or on the bottom.

For some workings, the gripping means or plier gripping the bodies from the bottom and for a limited area of their side surface may also require, for some operations, the rotation along its axis in order to angularly orient the same bodies of a prefixed portion. The above in order to create also embossing or debossing localized impressions upon them with special tools in addition to the extended deformation of the side surface. Therefore, the proper stabilization and the accurate alignment of the bodies are essential conditions to obtain a product with suitable quality features.

Object of the present invention is to remove the above-mentioned drawbacks.

More particularly, object of the present invention is to provide a process for the shaping of the side surface of a metal body or container, generally but not limited to a container made of aluminium or its alloys such as an aerosol a beverage bottle, for food or technical use wherein during the various and related operating steps, said body or container is initially stabilized and then kept blocked with a continuous accuracy and efficiently even though it is gripped by the gripping means along a limited area of the side surface from the bottom.

A further object of the invention is to provide a process as defined above wherein the body or container is stabilized according to an accurate axial alignment which is constantly kept in spite of the considerable loads deriving from the action of the deformation tools acting from the inside or from the outside or both the directions on a broad part of the side surface of the same body. A further object of the invention is to provide a process wherein the gripping strength of the body is properly contrasted intervening on its bottom in order to avoid the buckling near the base or in correspondence with it.

According to the present invention, these and other purposes are achieved by a process particularly for the shaping of the side surface of a metallic container such as an aerosol or beverage bottle, for food or technical use obtained by the progressive operating steps of deformation of its side surface carried out in sequence with a machine comprising at least an intermittent moving rotating table, at least an opposite alternate translatory motion plate, a loading drum, gripping pliers of the bodies, deformation and possibly embossing and/or debossing tools and an unloading drum of the same bodies, said process comprising steps consisting in: feeding said bodies on the machine provided with at least an intermittent moving rotating table and of at least an opposite translatory motion plate; gripping said bodies along an area of their side surface from the bottom with a fixed or an axially rotating gripping means or plier; carrying out a deformation on the side surface of the bodies with tools working from the inner and/or outer part of the same bodies; wherein: the bodies are gripped along a limited area of their side surface comprised between 10.0 and 35.0 mm from the bottom, the bottom of the bodies is moulded or partial drawn to form a concave area having geometrical features correlated to the geometry of the gripping pliers, and the deformation is carried out along an extensive area of the side surface of the body developing from the adjacent or close to the gripped part.

Figure 2:
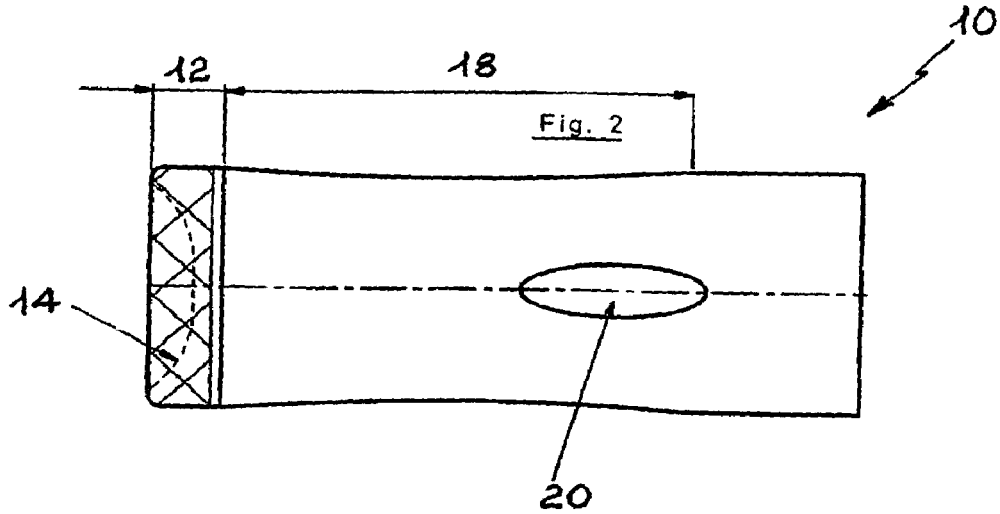
Figure 3:
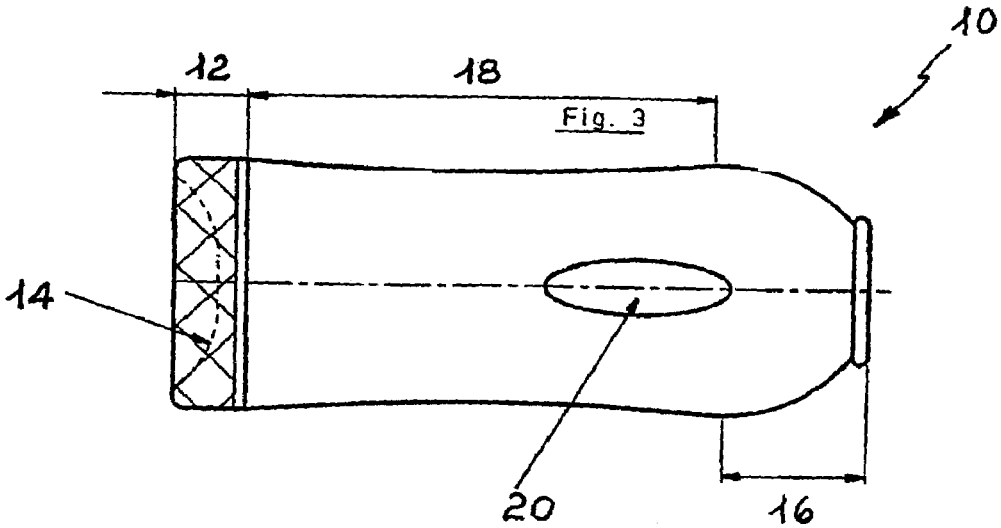

The process of the present invention is described here below with reference to the attached table of drawings wherein:

FIG. 1 schematically shows a side view of the unrefined body or container with molded or partially drawn bottom;

FIG. 2 schematically shows a side view of the same container upon which the deforming of the side surface has been carried out according to the process of the invention and upon which an embossing and/or debossing impression has been also obtained;

FIG. 3 schematically shows the same container upon which some tapering operations of the upper part with mouthpiece flanging have been carried out after the process of the present invention.

According to the process of the invention, the metal bodies to be shaped are fed and come, painted or not, on the loading drum of the machine provided with the intermittent moving rotating table with stations equipped with gripping pliers cooperating with tools and spindles. Advantageously, before said bodies are submitted to the deformation steps of their side surface, a working tool which is preferably placed on the machine or near it, carries out a first deformation operation upon them and particularly on the bottom. This deformation consists in a partial drawing of the bottom of the bodies determining a broad concave area upon them.

This concave area, on one side, stiffens the same bodies at the base on one side, i.e. in the area wherein they are subsequently blocked by the various pliers and, on the other side, it creates a hollow having the geometrical features corresponding to the geometry of the gripping means or plier which allows the immediate or subsequent application of a vacuum or equivalent stabilization or pre-stabilization means to the bottom. Instead of the vacuum, the stabilization of the bodies in the deformed part of the bottom can be obtained by suction cups, adhesive pads, magnetic pads if they are consistent with the material forming the bodies. It is, in fact, necessary to achieve and to keep an accurate adhesion or a perfect overlapping of the profiles among the bodies and the relevant gripping tools, in order to obtain an accurate geometric alignment of the container axis and in order to have enough connection strength between the container and the gripping means or plier. Once the molding of the bottom has been carried out, the bodies are gripped and blocked by the gripping tools and submitted to the progressive deforming operations of their side surface on the machine provided with at least one intermittent moving rotating table. The various tools or spindles, which the plate moves in translatory and alternative way, sequentially intervene on the same bodies to shape their side surface according to the required shapes. During these operating steps embossing or debossing operations connected among them or alternated to shaping or deformation of the side surface can be carried out.

Preferably, the molding or deformation of the bottom is advantageously carried out on the loading drum of the machine. The molding of the bottom of the bodies which is carried out at the beginning of the cycle allows stiffening the same bodies at the base which can be gripped by the pliers for a limited part comprised between 10.0 and 35.0 mm of their side surface.

This portion is preferably comprised between 15.0 and 30.0 mm. According to a further preferred embodiment, said portion is comprised between 16.0 and 25.0 mm.

The partial drawing obtained on the bottom of the bodies after the molding, determines a broad concavity with geometrical features correlated to the geometry of the gripping tool or plier which contrasts its gripping strength and allows applying an air vacuum or equivalent means to properly and steadily hold the same bodies aligned for the whole operating cycle.

In addition to the accurate stabilization, which is obtained in spite of the limited gripping extension along the side surface of the bodies, the bodies remain properly aligned during the various deforming or embossing and/or debossing operating steps, in spite of the high loads to which they are submitted by the tools intervening on a broad part of their side surface from the inner or the outer or both directions.

Once the deformation on the side surface is carried out, the bodies are unloaded from the machine in the known way or submitted, on the same machine, to other operating steps which, for example, consist in the tapering of their upper part. FIG. 1 schematically shows a side view of the unrefined body or container 10 with molded bottom or partially drawn; while FIG. 2 schematically represents, in side view, the same container upon which the deformation of the side surface according to the process of the invention has been carried out and upon which an embossing/debossing impression has been also obtained. FIG. 3 shows the same container upon which tapering operations of its upper part with flanging of the mouthpiece have been carried out after the process of the present invention.

The limited extended part of its side surface from the bottom, which is gripped by the gripping means or plier, is marked with number 12 and the extension of this area is advantageously comprised between 16.0 and 25.0 mm. The dotted part 14 shows the deformation of the bottom according to a geometry which is related to the one of the gripping means or plier and which consists in a hollow obtained by a molding operation or partial drawing.

The side surface of the body 10 is extensively shaped and develops, by way of example, from the area adjacent or close to the gripped part 12, which is kept by the gripping means or plier in order to reach or approach to tapered upper area 16.

The shaped side surface of the body 10 is marked with number 18 and the configuration of this shaping is to be meant as an example. In the same figure an embossing or debossing impression is marked with 20 and together with other impressions of any shape and/or development is obtained during the deformation process of the bodies 10 before, during and after the steps making the same deformation.

Even though the present invention has been described above with reference to a process, various changes and variants can be made according to the above-mentioned description.

The present invention is therefore meant to embrace all the changes and variants falling within the spirit and the protective scope of the following claims.

The invention claimed is:

1. A process for the shaping of a side surface of a metal body or container (10), obtained by progressive deformation operating steps of its side surface carried out in sequence on a machine comprising at least an intermittent moving rotating table, at least an opposite alternate translatory motion plate, a loading drum, gripping pliers of the metal body, deformation and optionally embossing and/or debossing tools and an unloading drum for said metal body, said process comprising the steps consisting of:

feeding said body (10) on the machine provided with at least one intermittent rotating table and with at least one opposite translatory motion plate;

gripping said body (10) along an area of the side surface from the bottom with a fixed or an axially rotating gripping means or plier;

carrying out a deformation on the side surface of the body (10) with tools working from the inner and/or the outer directions of the body (10), wherein the improvement comprises: molding or partial drawing the bottom of the body (10) to form a concave area (14) having geometrical features correlated to the geometry of the gripping plier prior to said gripping step;

gripping the body (10) along a limited area (12) of the side surface comprised between 10.0 and 35.0 mm from the bottom; and deforming the side surface of the body (10) along an extensive area (18) developing from an area adjacent or close to the gripped part (12).

2. The process according to claim 1, wherein the plier gripping area of the side surface of the body (10) from the bottom is comprised between 15.0 and 30.00 mm.

3. The process according to claim 1, wherein the plier gripping area of the side surface of the body (10) from the bottom is comprised between 16.0 and 25.0 mm.

4. The process according to claim 1, wherein the extensive deformation area (18) of the side surface of the body (10) develops from the area adjacent to the area (12) held by the gripping means or plier and reaches or approaches to the an upper area (16) of the body to be tapered.

5. The process according to claim 1, wherein the molding or partial drawing (14) of the bottom of the body (10) is carried out at or near machine edge.

6. The process according claim 1, wherein the molding or partial drawing of the bottom of the body (10) is carried out on the loading drum of the machine.

7. The process according to claim 1, wherein the concave area of the bottom of the body is stabilized to achieve an accurate adhesion of the profiles among the body and the relevant gripping pliers by a stabilization means.

8. The process according to claim 7, wherein the concave area of the bottom of the body is stabilized by an air vacuum.

9. The process according to claim 7, wherein the concave area of the bottom of the body is stabilized by suction cups.

10. The process according to claim 7, wherein the concave area of the bottom of the body is stabilized by adhesive pads.

11. The process according to claim 7, wherein the concave area of the bottom of the body is stabilized by magnetic pads.

* * * * *